US006082978A

United States Patent [19]

Tetour et al.

[11] Patent Number: 6,082,978

[45] Date of Patent: Jul. 4, 2000

[54] VALVE DEVICE IN A PISTON COMPRESSOR

[75] Inventors: Milan Tetour, Rudolfov; Roman Kriz, C. Budejovice, both of Czech Rep.

[73] Assignee: Knorr-Bremse, Munich, Germany

[21] Appl. No.: 09/149,458

[22] Filed: Sep. 9, 1998

[30] Foreign Application Priority Data

Sep. 10, 1997 [DE] Germany ..... 197 39 662

[51] Int. Cl.[7] ..... F04B 7/00; E03B 65/20

[52] U.S. Cl. ..... 417/510; 137/614.2

[58] Field of Search ..... 417/510, 298, 417/295

[56] References Cited

U.S. PATENT DOCUMENTS

| | | | |
|---|---|---|---|
| 3,926,214 | 12/1975 | Hrabal | 137/851 |
| 3,930,760 | 1/1976 | Winter | 417/284 |
| 4,253,031 | 2/1981 | Frister | 290/52 |
| 4,304,534 | 12/1981 | Meise et al. | 417/569 |
| 4,362,473 | 12/1982 | Zeilon | 417/68 |
| 4,390,325 | 6/1983 | Elo et al. | 417/379 |
| 4,877,046 | 10/1989 | Albrigtsen et al. | 137/107 |
| 5,129,795 | 7/1992 | Hyland | 417/423.12 |
| 5,879,145 | 3/1999 | Baumgartner | 417/524 |

FOREIGN PATENT DOCUMENTS 3329790 2/1985 Germany .

*Primary Examiner*—Teresa Walberg
*Assistant Examiner*—Jeffrey Pwu
*Attorney, Agent, or Firm*—Ronald E. Greigg; Edwin E. Greigg

[57] ABSTRACT

A piston compressor has a valve support, which closes a compression chamber and has an intake valve. A non-rotatable lamella can be moved between two positions, in one position the lamella lifts up from the valve support, leaving intake openings unblocked and in another position, the lamella closes the intake openings. A device is provided on the piston compressor for interrupting the supply. This device has a plate that is disposed between the lamella and the valve support and can be moved into two positions. The plate has openings, which continue the intake openings of the valve support. In the one position of the plate, its intake openings are covered by the lamella. In another position of the plate, intake openings thereof and the intake openings of the valve support are left unblocked by through openings in the lamella. The piston compressor can be used in compressed air brake systems of commercial vehicles.

13 Claims, 2 Drawing Sheets

VALVE DEVICE IN A PISTON COMPRESSOR

BACKGROUND OF THE INVENTION

The invention is based on a valve device in a piston compressor.

This kind of valve device in a piston compressor has already been disclosed (DE 33 29 790 C2) in which on the outside of the lamella of the intake valve, which lamella is fastened to the valve support, a second lamella embodied in an S-shape and belonging to a second intake valve is disposed so that it can be pivoted into two positions on the valve support. The second lamella is received in a housing recess between the first lamella mentioned and the valve support, which recess is adapted in its outline to the position of the second lamella in its two positions in such a way that the edges of the recess define the pivoting path of the second lamella. In its one position, this lamella covers two associated intake openings of the valve support (load operation of the piston compressor); in its other position, it unblocks the intake openings so that the supply of the piston compressor is interrupted (idling operation).

By means of this embodiment, the piston compressor is relatively costly, since apart from the second lamella, additional intake openings are required, which have a complicated cross section and are adapted to the form of the second lamella. In addition, the lamellas touching each other become worn faster.

Piston compressors that are highly loaded thermally are disadvantageously exposed to the deposit of oil carbon in the compression chamber. Since in the known valve device, the housing recess for the second lamella is partially open, oil carbon can be deposited there and can gradually restrict or block the adjustment path of the lamella. A uniform operational behavior of the piston compressor is then no longer assured.

OBJECT AND SUMMARY OF THE INVENTION

The valve device according to the invention has the advantage over the prior art that the interruption of the supply of the piston compressor is achieved without adjusting a lamella. In addition, there is only one intake valve. The valve device according to the invention, though, has a plate that is used as a valve seat plate of the intake valve. By adjusting this plate, the piston compressor can be switched to load operation or idling operation. The plate is not as damage-prone as a lamella. In addition, the plate is to a large extent covered by the lamella and is subjected less intensely to the depositing of oil carbon. On the whole, therefore, a piston compressor equipped with the valve device according to the invention is more reasonably priced and operationally reliable than a piston compressor according to the prior art.

Advantageous improvements and updates of the valve device are possible by means of the measures set forth herein.

A structurally favorable embodiment of the valve device is disclosed hereinafter. The circular, annular plate covers its movement path so that oil carbon deposits cannot restrict its adjustment path.

The improvement of the valve device disclosed is advantageous since the longitudinal opening, which has no valve seat function, can be produced in a reasonably priced manner, for example when casting the valve support, and possibly requires no machine finishing.

On the one hand, a radial and axial guidance of the plate is produced in a simple manner and on the other hand, oil carbon is prevented from being deposited on the outer edge. On the inner edge of the plate, there is no danger of this since an intense air flow prevails there.

A lamella of a proven shape is disclosed, which merely has additional through openings in order to achieve the function of interrupting the supply of the piston compressor.

Through the improvement of the valve device set forth herein, the engagement of the adjusting means is disposed in a region that is protected from the compression chamber by means of the lamella.

The elements measure disclosed herein relate to an operationally reliable, low-cost embodiment of the adjusting means.

With the embodiment of the valve device as set forth, a connection between the piston of the adjusting means and the plate is produced in a simple manner.

The disclosed arrangement of elements further increases the functional reliability of the valve device.

A suitable embodiment of the valve device is presented, which prevents the penetration of impurities, in particular oil carbon, into the adjustment means. The embodiment increases this protective function further.

The improvement of the valve device set forth herein provides a simple solution to the problem that the plate as well as the flat slide valve on the one hand, and the pin of the piston on the other hand have differently proceeding adjusting paths.

A very simply embodied catch is disclosed, which produces a positive fit engagement between the plate, the flat slide valve, and the pin of the piston. This catch is disposed underneath the lamella, in its clamping region. The catch is therefore disposed in a protected fashion and cannot fall into the compression chamber of the piston compressor.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
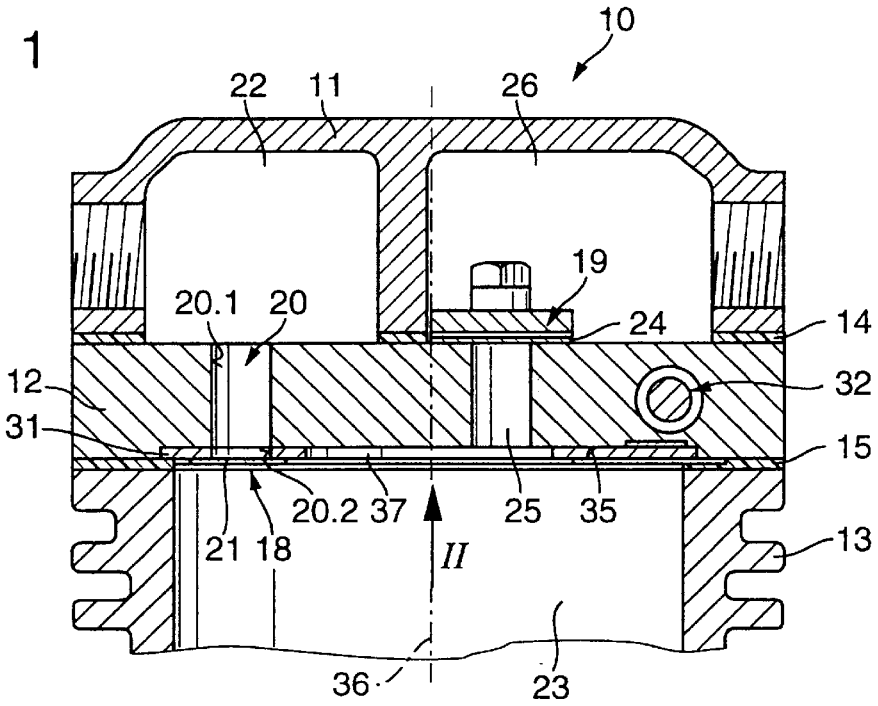
FIG. 1 is a section through a part of a piston compressor on the cylinder head end, along the continuous line I—I in FIG. 2.

A part of a piston compressor 10 on the cylinder head end, which part is depicted section ally in FIG. 1 of the drawings, of the kind that is used, for example, in compressed air brake systems of commercial vehicles, has a cylinder head 11, a valve support 12, and a cylinder 13. The components mentioned are secured to one another in a manner not shown, with the interposition of flat seals 14 and 15. A piston (not shown) is contained in the cylinder 13. Conduits in the valve support 12 for cooling water are likewise not shown.

An intake valve 18 and an outlet valve 19 are disposed on the valve support 12. The intake valve 18 is comprised of a number of intake openings 20 and a lamella fastened to the valve support 12. This lamella can be moved between two positions. In the first of these positions, the lamella leaves the intake openings 20 unblocked and produces a connection between an intake chamber 22 of the cylinder head 11 and a compression chamber 23 of the cylinder 13. In the other position, the lamella 21 closes the intake openings 20. Therefore, the intake valve 18 is a check valve. The outlet valve 19 is likewise a check valve. It has a strip-shaped outlet lamella 24, which is associated with outlet openings 25 in the valve support 12. The outlet valve 19 opens in the direction from the compression chamber 23 to a pressure chamber 26 of the cylinder head 11 and closes in the opposite direction.

The operation of the piston compressor 10 called load operation, in which as a function of the piston movement, air from the intake chamber 22 is aspirated into the compression chamber 23, compressed there, and fed into the pressure chamber 26 for transmission to a compressed air consumer, is known and requires no further description. The piston compressor 10 is furthermore provided with a device 30 for interrupting the compressed air supply, which device will be described below in conjunction with the additional FIGS. 2 to 4. This operating state of the piston compressor 10 is called idling operation.

The device 30 is comprised essentially of a plate 31 disposed on the valve support 12 and an adjusting means 32 with which the plate can be rotated from a first position that preserves the function of the intake valve 18 (load operation) into a second position in which the intake valve is ineffective (idling operation).

The plate 31 is embodied as circular and annular, and has a slightly larger outer diameter than the bore 23 of the cylinder. The plate 31 is contained so that it fits in a recess 35 of the valve support 12 in such a way that it ends flush with the end face of the valve support on the compression chamber side. The lamella 21 of the intake valve 18, which lamella is attached to the valve support 12, thus extends along the plate 31. The center point of the plate 31 is disposed in its rotational axis 36, which coincides with the longitudinal axis of the cylinder 13. On the outer edge side, the plate 31 is largely overlapped by the flat seal 15 clamped between the valve support 12 and the cylinder 13. A central recess 37 of the plate 31, which recess is disposed concentric to the axis 36, leaves the two outlet openings 25 of the outlet valve 19 unblocked.

Figure 2:
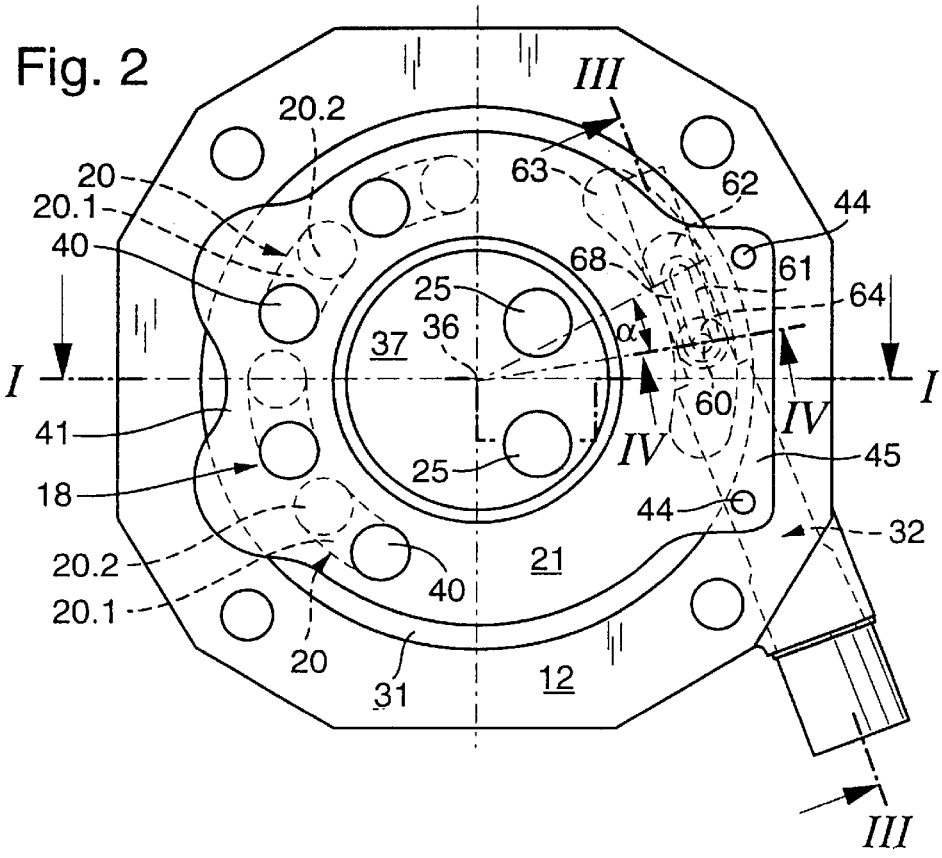
FIG. 2 is a view of a valve device on a valve support of the cylinder head, viewed in the direction of the arrow II in FIG. 2.

The intake valve 18 has four intake openings 20 (FIG. 2). These are embodied in the valve support 12 as longitudinal openings 20.1 and are continued in the plate 31 as circular through openings 20.2. The longitudinal openings 20.1 of the valve support 12 and the through openings 20.2 of the plate 31 are disposed on the same arc around the axis 36. The lamella 21 is provided with four circular through openings 40 that are likewise disposed on the same arc. These have a diameter that corresponds to the through openings 20.2 of the plate 31.

It can also be seen from FIG. 2 that each longitudinal opening 20.1 of the valve support 12 is associated with a through opening 20.2 of the plate 31 and a through opening 40 of the lamella 21. In the projection in the plane of the drawing, the through openings 20.2 and 40 are disposed inside the outline of the longitudinal opening 20.1. The through openings 20.2 of the plate 31 are overlapped by an arc segment 41 of the lamella, which is embodied as circular and annular. In the load operation of the piston compressor, the plate 31 assumes the position shown in FIG. 2 and the intake valve 18 functions as a check valve.

In its section disposed opposite the arc segment 41, the lamella 21 is widened out radially and is non-rotatably fastened to the valve support 12 with two cylinder pins 44. The adjusting means 32 engages the plate 31 below this lamella section 45. The adjusting means 32 can rotate the plate 31 out of the position shown by the angle $\alpha$ so that at the end of the adjusting path, the through openings 20.2 of the plate come to rest so they are congruent to the through openings 40 of the lamella 21. This renders the intake valve 18 ineffective and the piston compressor 10 functions in the idling operation.

Figure 3:
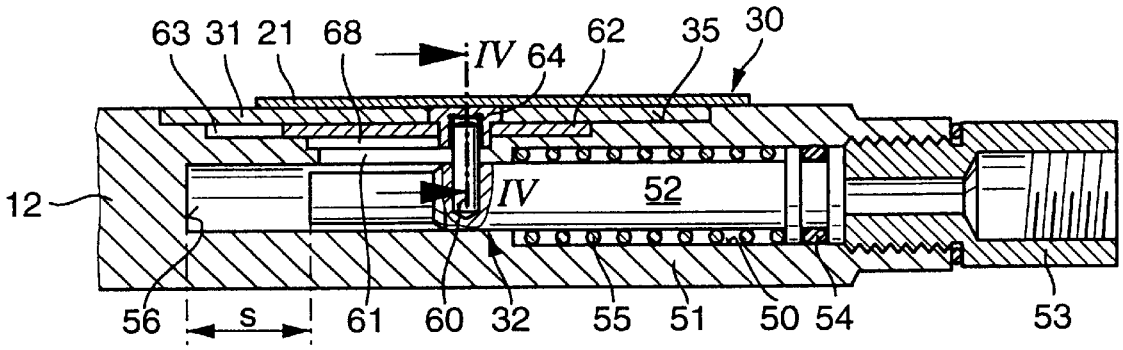
FIG. 3 is a section through the valve support, which has an adjusting means for the valve device, along the line III—III in FIG. 2.

The adjusting means 32 is essentially comprised of a cylinder 51 produced by means of a bore 50 in the valve support 12 and a piston 52 guided in it (FIG. 3). The cylinder 51 is closed in relation to the outside by means of a screw-in fitting 53 for feeding control pressure. The piston 52, which is sealed in relation to the cylinder 51 with a sealing ring 54, can be moved out of its rest position, in which it is supported against the screw-in fitting 53, into its working position by overcoming the stroke s with the action of the control pressure counter to the force of a compression spring 55 contained in the bore 50, and its working position is determined by the piston 52 striking against the bottom 56 of the bore 50.

Figure 4:
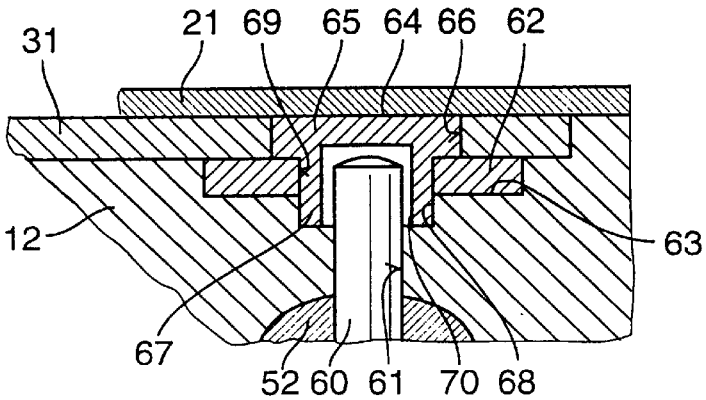
FIG. 4 is a section through a part of the adjusting means, along the line IV—IV in FIG. 3, in a larger scale than in FIG. 3.

A cylinder pin 60 is press-fitted into the piston 52, which can move parallel to the plate 31, and this pin, extending parallel to the rotational axis 36 of the plate, reaches through the valve support 12 on the compression chamber side into a slot 61 (FIG. 4). This slot serves to guide the cylinder pin 60 and, in the same manner as the piston 52, extends at least almost tangentially to the circular path of the plate 31. The slot 61 has a length that corresponds to the stroke s. The slot 61 is sealed by a sliding seal in the form of a flat slide valve 62 disposed between the plate 31 and the valve support 12. The flat slide valve 62 is received in a recess 63 so that it extends flush to the end face of the valve support 12 on the compression chamber side. This recess extends concentrically to the rotational axis 36 of the plate 31. The flat slide valve 62, which is embodied as arc-shaped in the view according to FIG. 2, has a length that covers the slot 61 in the valve support 12 in both positions of the plate 31. Correspondingly, the length of the recess 63 is matched to the adjustment path of the flat slide valve 62.

The plate 31, the flat slide valve 62, and the pin 60 of the piston 52 are coupled by means of a catch in the form of a cylindrical cap 64. This reaches so that it fits through the plate 31 and the flat slide valve 62, while the pin 60 engages in the cap 64 with radial play. This play is necessary in order, when adjusting the plate 31, to absorb the relative motion between the pin 60, which follows a straight path, and the flat slide valve 62, which is guided on a curved path.

The cap 64, which is stepped on the outside, has a bottom 65, which engages so that it fits in a circular through opening 66 of the plate 31 and ends flush with the end face of the plate on the lamella side. Starting from the bottom 65, the cap 64 is continued in a smaller diameter section 67. This engages in a recess 68 of the valve support 12, which, in the projection according to FIG. 2, encompasses the slot 61 and follows the arc of the recess 63. The section 67 reaches so that it fits through the flat slide valve 62 into a circular through opening 69. The cap 64 is provided with a blind bore 70 for the engagement of the cylinder pin 60, which bore starts from the side remote from the bottom.

The foregoing relates to preferred exemplary embodiments of the invention, it being understood that other variants and embodiments thereof are possible within the spirit and scope of the invention, the latter being defined by the appended claims.

We claim:

1. A valve device in a piston compressor (10), for a compressed air brake system of commercial vehicles, which comprises the following features:

a valve support (12) which closes a compression chamber (23) of the piston compressor (10), at least one intake valve (18) which comprises at least one intake opening (20) and a lamella (21) that is attached at least indirectly to the valve support (12), the lamella (21) is moved between two positions, in the first position the lamella lifts up from the valve support (12) so that it leaves the at least one intake opening (20) unblocked and in another position, the lamella closes the intake opening (20), a device (31, 32) is provided for interrupting a supply of the piston compressor (10), the lamella (21) has at least one through opening (40) on the at least one intake valve side, a plate (31) is disposed between the lamella (21) and the valve support (12), the intake opening (20) of the valve support (12) is continued in the plate (31), the plate (31), rests against the valve support (12), can be moved into two positions, in the one position of the plate, the intake opening (20) is covered by the lamella (21), in another position of the plate (31), the intake opening (20) is left unblocked by the through opening (40) in the lamella (21).

2. The valve device according to claim 1, in which that the plate (31) is embodied as circular and annular, and is received on the valve support (12) so that said plate can rotate around a center point, wherein the intake opening (20.1, 20.2) in the valve support (12) and the plate (31) as well as the through opening (40) of the lamella (21) are disposed at least almost on a same arc around the rotational axis (36) of the plate (31).

3. The valve device according to claim 2, in which the intake opening (20.1) in the valve support (12) is embodied as a longitudinal opening.

4. The valve device according to claim 2, in which the plate (31) is received so that the plate fits in a recess (35) of the valve support (12) and on an outer edge, the plate is overlapped to a large extent by a flat seal of the piston compressor (10).

5. The valve device according to claim 2, in which the lamella (21) is embodied as circular and annular and has a number of through openings (40), which cooperate with intake openings (20) and are disposed on an arc section (41) that is disposed opposite a section (45) of the lamella (21) at which it widens out radially and is non-rotatably fastened resting at least indirectly against the valve support (12).

6. The valve device according to claim 5, in which an adjusting means (32) is provided in the valve support (12), said adjusting means engages the plate (31) at least indirectly in a region of the widened lamella section (45) and rotates the plate into two different positions.

7. The valve device according to claim 6, in which the adjusting means (32) has a cylinder disposed in the valve support (12) with a piston (52) that is acted on by pressure and is moved counter to a spring force parallel to the plate (31), and the stroke (s) of this piston (52), which determines the adjusting path of the plate (31), is defined by stops (53, 56).

8. The valve device according to claim 7, in which a pin (60) is inserted into the piston (52) and, extending parallel to the rotational axis (36) of the plate (31), said pin reaches through the valve support (12) on the compression chamber side, and is guided into a slot (61) of the valve support (12), said slot extends at least almost tangentially to the circular path of the plate (31).

9. The valve device according to claim 8, in which the slot (31) is sealed by a sliding seal (62) disposed between the plate (31) and the valve support (12).

10. The valve device according to claim 9, in which the sliding seal is embodied as a flat slide valve (62) that is coupled at least indirectly to the pin (60) of the piston (52) and has a length that covers the slot (61) in both positions of the plate (31).

11. The valve device according to claim 10, in which the flat slide valve (62) is guided in a recess (63) of the valve support (12), which recess runs concentric to the rotational axis (36) of the plate (31).

12. The valve device according to claim 11, in which the plate (31), the flat slide valve (62), and the pin (60) of the piston (52) are coupled by means of a catch (64) which reaches so that said catch fits through the plate (31) and the flat slide valve (62), while the pin (60) engages in the catch with radial play.

13. The valve device according to claim 12, in which the catch is embodied as a cylindrical cap (64) that is stepped on the outside, which with its bottom (65), ends flush with the end face of the plate (31) on the lamella side, has a smaller diameter section (67) for the passage through the flat slide valve (62) and is provided with a blind bore (70) for the pin (60) of the piston (52), which bore starts from the side remote from the bottom.

* * * * *